United States Patent [19]

Rothkegel et al.

[11] Patent Number: 4,855,104

[45] Date of Patent: Aug. 8, 1989

[54] METHOD FOR THE PRODUCTION OF SINTERED ELECTRICAL CONTACT MATERIAL FOR LOW VOLTAGE POWER SWITCHING

[75] Inventors: Bernhard Rothkegel, Nuremberg; Wolfgang Haufe, Hessdorf, both of Fed. Rep. of Germany

[73] Assignee: Siemens Aktiengesellschaft, Berlin and Munich, Fed. Rep. of Germany

[21] Appl. No.: 190,804

[22] Filed: May 6, 1988

Related U.S. Application Data

[62] Division of Ser. No. 930,958, Nov. 12, 1986.

[30] Foreign Application Priority Data

Jun. 12, 1984 [DE] Fed. Rep. of Germany ..... 3421758

[51] Int. Cl.[4] ..... B22F 3/24

[52] U.S. Cl. ..... 419/28; 75/234; 198/431; 200/265; 419/2/; 419/21; 419/22; 419/32; 419/34; 419/38; 419/55

[58] Field of Search ..... 419/32, 38, 34, 21, 419/22, 28, 29, 55; 75/234; 148/431; 200/265

[56] References Cited

U.S. PATENT DOCUMENTS

| | | | |
|---|---|---|---|
| 3,954,459 | 5/1976 | Schreiner et al. | 75/206 |
| 4,141,727 | 2/1979 | Shida et al. | 75/232 |
| 4,204,863 | 5/1980 | Schreiner | 75/234 |
| 4,551,301 | 11/1985 | Schreiner | 419/21 |
| 4,565,590 | 1/1986 | Grosse et al. | 148/431 |
| 4,681,702 | 7/1987 | Schreiner et al. | 252/518 |
| 4,764,227 | 8/1988 | Rothkegel et al. | 75/247 |

*Primary Examiner*—Stephen J. Lechert, Jr.
*Attorney, Agent, or Firm*—James G. Morrow

[57] ABSTRACT

Contact materials based on $AgSnO_2$ and having $Bi_2O_3$ and CuO as further metal oxide additives were previously disclosed. In these materials the total content of all metal oxides was supposed to be between 10 and 25% by volume with the $SnO_2$ share equal to or greater than 70% by volume of the total amount of oxide.

According to this invention the quantity of $SnO_2$ is kept smaller than 70% by volume; specifically at about 65%, but in any case equal to or greater than 50%. The $SnO_2$ weight content is to be in the 4% to 8% range and the weight percentage ratio of $SnO_2$ to CuO is to be between 8:1 and 12:1.

In the associated production process, either $Bi_2O_3$ powder is purposely admixed to an internally oxidized alloy powder (IOAP) in an additional operation, a grain restructuring with locally different $Bi_2O_3$ concentrations occurring in the structure after sintering and compacting. Alternatively, higher bismuth percentages in the alloy powder can be worked with directly, which is again internally oxidized to an IOAP. From these starting materials two-layer sintered contact elements with a solderable silver layer can be efficiently produced.

7 Claims, 1 Drawing Sheet

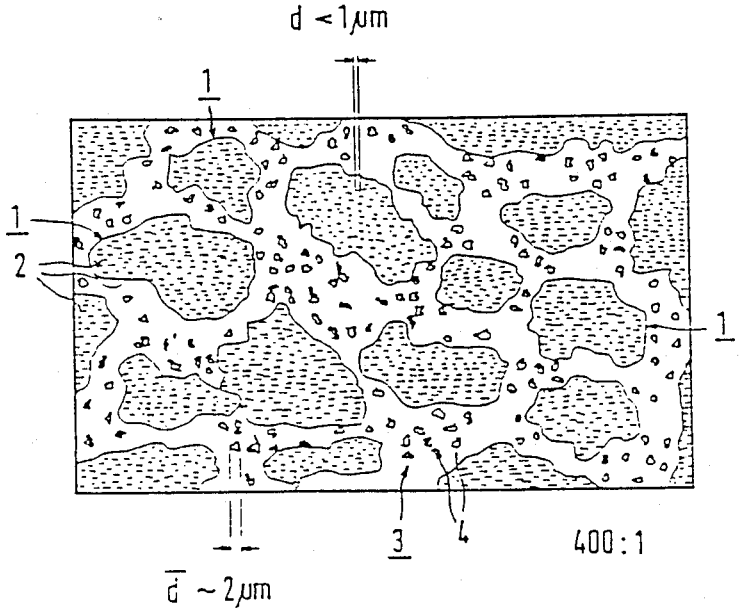
d < 1μm
1
1
2
1
3
4
400 : 1
d̄ ~ 2μm

METHOD FOR THE PRODUCTION OF SINTERED ELECTRICAL CONTACT MATERIAL FOR LOW VOLTAGE POWER SWITCHING

This is a division of application Ser. No. 930,958 filed Nov. 12, 1986.

BACKGROUND OF THE INVENTION

The present invention relates to a sintered, electrical contact material for low voltage power switchgear, comprising $AgSnO_2$ as well as $Bi_2O_3$ and CuO as further metal oxides, and having a total metal oxide content of between 10% and 25% by volume. In addition, the invention relates also to specific methods for the production of such material.

Such a material is the subject of the commonly-owned U.S. patent application Ser. No. 577,750, filed Feb. 7, 1984 entitled "SINTERED, ELECTRICAL MATERIAL FOR LOW VOLTAGE POWER SWITCHING".

Contact materials on the basis of silver and metal oxides (AgMeO) have proven to be particularly advantageous for low voltage power switchgear; e.g., in contactors or automatic circuit breakers. In the past, where cadmium oxide, in particular, has been used as an active component, these contact materials have specifically met the desired electro-technical properties and have proven successful in the long-term use of switchgear. But since, as is known, cadmium is one of the toxic heavy metals and CdO is emitted into the environment as the contact elements burn off, it has been endeavored for some time to replace the CdO by other metal oxides as completely as possible. The requirements for these materials are that they burn off just as little as do AgCdO materials in the arc; that they have just as little welding force; and, especially, that they heat up just as little when carrying constant current as the proven AgCdO materials for contact elements.

So far, attempts have been made to replace the cadmium by tin or zinc. However, the known contact compositions with $AgSnO_2$ and AgZnO have been generally unable to reach the high-grade properties of AgCdO contact elements. In particular, when using contact elements made of AgSnO as alternative material for AgCdO, it has turned out that, due to its higher thermal stability, $AgSnO_2$ develops a higher transfer resistance than AgCdO because an oxide layer forms due to the effects of arcing. In the current-carrying state of the switchgear, this causes impermissibly high temperatures to develop in the contact elements which may damage the switchgear. On the other hand, $AgSnO_2$ contact elements burn off less than do AgCdO contact elements, resulting in longer life. The required size of the contact elements can therefore advantageously be reduced in comparison to AgCdO, thereby achieving a not inconsiderable saving in silver.

The aforementioned U.S. patent application Ser. No. 577,750 discloses a new sintered contact material for the above purpose, based on $AgSnO_2$, in which $Bi_2O_3$ and CuO as well as, selectively, CdO are added as further metal oxides, and in which the total metal oxide content is between 10% and 25% by volume with the $SnO_2$ share equal to or greater than 70% by volume of the total oxide quantity. The contact material is produced powdermetallurgically from an internally oxidized alloy powder (so-called "IOAP"). For the cadmium-free alternative, the material of the following composition, in weight percentages, is given as being particularly advantageous:

87.95% Ag; 97% $SnO_2$; 9.98 $Bi_2O_3$; and 100% CuO.

Experiments have now shown that the stated material still does not fully meet the requirements of practical application as a contact material.

SUMMARY OF THE INVENTION

Accordingly, it is an object of the present invention to provide a different, superior material having the composition $AgSnO_2Bi_2O_3CuO$ for the above-mentioned application, and to provide associated production methods.

This object, as well as further objects of the present invention, are achieved, according to the present invention, by producing the material with the $SnO_2$ content being less than 70% by volume of the total oxide quantity, with the $SnO_2$ content by weight being in the range of 4% to 8%, and with the weight percent ratio of $SnO_2$ to CuO being between 8:1 and 12:1. The volumetric $SnO_2$ pecentage is preferably about 65% of the total oxide quantity, amounting to at least 50% in any case. A composition, in weight percentages, of 6,33% or 6.4% $SnO_2$, 3,27% or 3.51% $Bi_2O_3$, 0,72% or 0.71% CuO, and the rest silver has proven to be particularly successful. In the first case the $Bi_2O_3$ content is 0,64% part of an IOAP and 2,63% a separate oxide.

The relatively favorable properties of materials of the composition $AgSnO_2Bi_2O_3CuO$ have been recognized for some time. Besides the above-mentioned U.S. patent application Ser. No. 577,750, such materials are also mentioned in U.S. Pat. No. 4,141,727. In the materials described therein, however, the $SnO_2$ percentage chosen is relatively low, being less than 4% in all cases except one. In this one special material, disclosed in the U.S. Pat. No. 4,141,727 as Example 18, the Sn weight percentage is 6%; but in this case the Cu percentage is so high that the weight percent ratio of Sn to Cu is 5:1.

In addition, the published U.K. patent application No. 2,055,398 describes materials based on silver metal oxide from which are produced alloy metal sheets that are subsequently internally oxidized. This U.K. patent application therefore does not concern material produced by powdermetallurgical methods, and particularly not the internal oxidation of alloy powders with subsequent compaction and sintering. In the process disclosed in this application, one starts with an initial alloy, for example having the composition, in weight percentages: 90.8% Ag, 8.5% Sn, 0.2% Bi, and 0.5% Cu. As is known in the art, other ingredients such as cobalt, iron, or nickel are always added additionally as alloys to these quaternary systems.

The present invention is based on the surprising recognition that the $SnO_2$ percentage of the total oxide quantity must be reduced to further improve the temperature properties; reduced so far, in fact, that its relative volumetric percentage of the total oxide quantity is below 70%. In addition, the $Bi_2O_3$ percentage of the material is increased considerably so that the mass percentage ratio of $SnO_2$ to $Bi_2O_3$ is now between 1 and 3.

In the method for producing the material according to the invention, an alloy powder of a given composition is internally oxidized. This can preferably be done by first producing, in known manner, an alloy with a comparatively low percentage of bismuth and then adding a separate $Bi_2O_3$ powder to the internally oxidized alloy powder after the oxidation. This creates a very specific structure with different oxide particle sizes, there being a grain restructuring with the formation of the mixed oxides. The electrical properties can be further influenced advantageously by different $Bi_2O_3$ distribution.

But, as an alternative, the sintered contact material according to the invention can also be produced by using an alloy powder with relatively high bismuth concentration as a starting material, from which a completely internally oxidized composite powder is producable.

Further details and advantages of the present invention follow from the description of two embodiment examples. For the production of the sintered contact materials the relative percentages of the individual components are always given in weight percent, from which the volumetric percentages of the oxides result on the basis of their different densities.

BRIEF DESCRIPTION OF THE DRAWING

The single FIGURE of the drawing is a metallurgical cross-section showing the grain structure of the contact material according to the present invention.

DESCRIPTION OF THE PREFERRED EMBODIMENTS

EXAMPLE 1

From 93.60% of fine silver granules, 5.20% tin granules, 0.60% metallic bismuth as fragments, and 0.60% copper in rod form an AgSnBiCu alloy of the above composition is melted at 1353° K. An alloy powder of the same composition is obtained therefrom by atomization of the melt in water in a pressure atomizer. After drying, the powder is screened to less than 200 μm. This powder component is internally oxidized between 773° K. and 872° K. in an atmosphere containing oxygen, whereupon a composite $AgSnO_2Bi_2O_3CuO$ powder is obtained having the composition 92.10% Ag, 6.5% $SnO_2$, 0.66$Bi_2O_3$, and 0.74% CuO in weight percent. Such a composite powder, which is internally oxidized quantitatively, is called an "IOAP".

To the above-noted $AgSnO_2Bi_2O_2CuO$ composite powder was added, in weight percent, a metal oxide additive of 2.7% $Bi_2O_3$, relative to the composite powder, by wet mixing with propanol in an agitator ball mill using steel balls. After drying, the steel balls were separated by screening from the powder mixture consisting of composite powder and bismuth oxide powder. The composition of the starting material for the contact material (composite powder and bismuth powder) is then, in weight percent, 89.68% Ag, 6.33% $SnO_2$, 3.27% $Bi_2O_3$, and 0.72% CuO.

From the starting material thus produced it is expedient to produce, for use as contact elements for low voltage power switchgear, two-layer molded parts with a solderable silver layer, the solidification of the contact elements taking place by sintering in air, hot compacting, sintering and cold compacting to form a virtually poreless material. Process technologies commonly used in the state of the art are employed for this purpose.

While the material is being sintered, a grain restructuring of the outer areas of the former composite powder particles occurs with the formation of mixed oxides. In these areas, therefore, there results a locally greater $Bi_2O_3$ concentration than in the interior of the particles.

The structure of a material thus produced shows oxide separations in two distributions: On the one hand there are coarse oxide separations having a diameter ($\bar{d}$) of approximately 2 μm on the average, and on the other hand fine oxide separations of a diameter (d) which is less than 1 μm, the latter being located in the interior of the former composite powder.

The single FIGURE shows a metallographic cross section (enlarged 400:1) of the structure of a material thus produced, from which the typical distribution of the mixed oxide separations is evident. In the FIGURE, the areas which originated from the alloy powder after internal oxidation are designated 1. The fine oxide separations 2 present in these areas have a diameter smaller than 1 μm and are essentially distributed statistically. Between the areas 1 are areas 3 with coarse oxide separations 4, whose diameter is approximately 2 μm on the average.

A particularly desirable feature of the new material produced by this process is the low residual porosity obtained without post warm pressing due to the liquid phase sintering of the separate $Bi_2O_3$ portion.

EXAMPLE 2

From 91.02% fine silver granules, 5.19% tin granules, 3.21% metallic bismuth as fragments and 0.58% copper in rod form is melted an AgSnBiCu alloy of the above composition. By atomization of the melt in water in a pressure atomizer there is obtained an alloy powder of the same composition. After drying, the powder is screened to less than 200 μm, and this powder component is internally oxidized between 723° K. and 873° K. in an atmosphere containing oxygen. In this manner, there is obtained a composite $AgSnO_2Bi_2O_3CuO$ powder of the composition, in weight percentages, 89.31% Ag, 6.47% $SnO_2$, 3.51% $Bi_2O_3$, and 0.71% CuO.

A two-layer press blank is produced directly from the composite powder, which is solidified by sintering, the residual porosity being reduced for suitable contact elements by hot or cold compaction.

In Example 2, the structure of the material is very fine and uniform, the mean size of the oxide separations being approximately 1.5 μm.

The welding force of the contact materials produced in accordance with the invention was determined in a test switch. The measured values obtained correspond essentially to those of an AgCdO12$Bi_2O_3$1.0 contact material produced from internally oxidized alloy powder. In addition, life and heating tests were conducted in motor contactors. The essential characteristics therefore are the AC4 life cycle number of the contact elements and the overtemperature of the current paths. In comparison with the AgCdO12$Bi_2O_3$1.0 materials, the number of life cycles is higher by a factor of about 2.4, and the overtemperatures are only up to about 10 degrees C. higher.

The comparative values are set forth in the following Table.

TABLE

| Example No. | Material In Weight Percent | Mfg. Method | AC4 Life Cycles | Overtemp. in °C. |
|---|---|---|---|---|
| Comparative Material | AgCd012$Bi_2O_3$1.0 | IOAP | ≈50,000 | 70–80 |
| 1 | $AgSnO_2$6,33$Bi_2O_3$0.64CuO0.72 + | IOAP | ≈120,000 | 80–90 |

TABLE-continued

| Example No. | Material In Weight Percent | Mfg. Method | AC4 Life Cycles | Overtemp. in °C. |
|---|---|---|---|---|
| | 2,63% $Bi_2O_3$ | | | |
| 2 | $AgSnO_2$6,47$Bi_2O_3$3,51CuO0,71 | IOAP | ≈120,000 | 80–90 |

Among other things, the present invention reduces the relative tin content by purposely increasing the bismuth content. This can be accomplished either by adding $Bi_2O_3$ powder separately to the IOLP, or else by increasing the bismuth percentage of the initial alloy prior to the oxidation. After quantitative internal oxidation, the volumetric percentage of all metal oxides governing the property spectrum remains within the given range. In all cases, the results were found to have unexpectedly good electrical switching behavior.

There has thus been shown and described a novel electrical contact material which fulfills all the objects and advantages sought therefor. Many changes, modifications, variations and other uses and applications of the subject invention will, however, become apparent to those skilled in the art after considering this specification and the accompanying drawing which discloses the preferred embodiments thereof. All such changes, modification, variations and other uses and applications which do not depart from the spirit and scope of the invention are deemed to be covered by the invention which is limited only by the claims which follow.

What is claimed is:

1. A method for producing an $AgSnO_2Bi_2O_3CuO$ sintered contact material comprising the steps of:

forming an internally oxidized $AgSnO_2Bi_2O_3Cu$ composite powder from an AgSnBiCu alloy;

mixing a $Bi_2O_3$ powder to the composite powder to form a mixture;

compacting the mixture; and sintering the mixture, wherein the contact material is formed into a dense contact for use in low voltage power switch gear.

2. The method according to claim 1, wherein the composition consists in weight percentages, of 93.60% fine silver, 5.2% tin, 0.60% metallic bismuth, and 0.6% copper melted and pressure atomized, and wherein 2.63% by weight of said $Bi_2O_3$ powder is added to the alloy powder, after complete internal oxidation, by wet mixing in an agitator mill.

3. The method according to claim 2, wherein at least one organic solvent is used in the step of wet mixing.

4. The method according to claim 3, wherein said organic solvent is propanol.

5. The method according to claim 1, wherein an alloy powder of the composition, in weight percentages, 91.02% fine silver, 5.19% tin, 3.21% metallic bismuth, and 0.58% copper is melted; the melt is pressure atomized; and the starting material is produced by complete internal oxidation of the alloy powders.

6. The method of claim 1 wherein the mixture is sintered above the melting point of the $Bi_2O_3$.

7. The method of claim 1 wherein the mixture is sintered twice and compacted twice such that the mixture is first sintered in air and hot compacted, and then the mixture is sintered and cold compacted.

* * * * *